US005490789A

United States Patent [19]

Simons

[11] Patent Number: 5,490,789

[45] Date of Patent: Feb. 13, 1996

[54] MOLDED CONNECTOR WITH INTERNAL GROUNDING

[75] Inventor: Raymond B. Simons, River Forest, Ill.

[73] Assignee: Methode Electronics, Inc., Chicago, Ill.

[21] Appl. No.: 171,818

[22] Filed: Dec. 22, 1993

[51] Int. Cl.[6] ..... H01R 9/00; H01R 43/00

[52] U.S. Cl. ..... 439/101; 29/856; 439/108

[58] Field of Search ..... 439/98, 101, 108, 439/620, 736; 29/856

[56] References Cited

U.S. PATENT DOCUMENTS 3,952,218 4/1976 Deters ..... 439/101 X

FOREIGN PATENT DOCUMENTS 2744949 4/1979 Germany ..... 439/736

*Primary Examiner*—William Briggs

*Attorney, Agent, or Firm*—David L. Newman; Eddie L. Bishop

[57] ABSTRACT

A molded electrical connector having a grounding and compression ground washer exposed and interposed in the outer surface of the molded body of the connector and having an internal integral tab welded to a ground wire both being surrounded by the molded body of the connector.

6 Claims, 2 Drawing Sheets

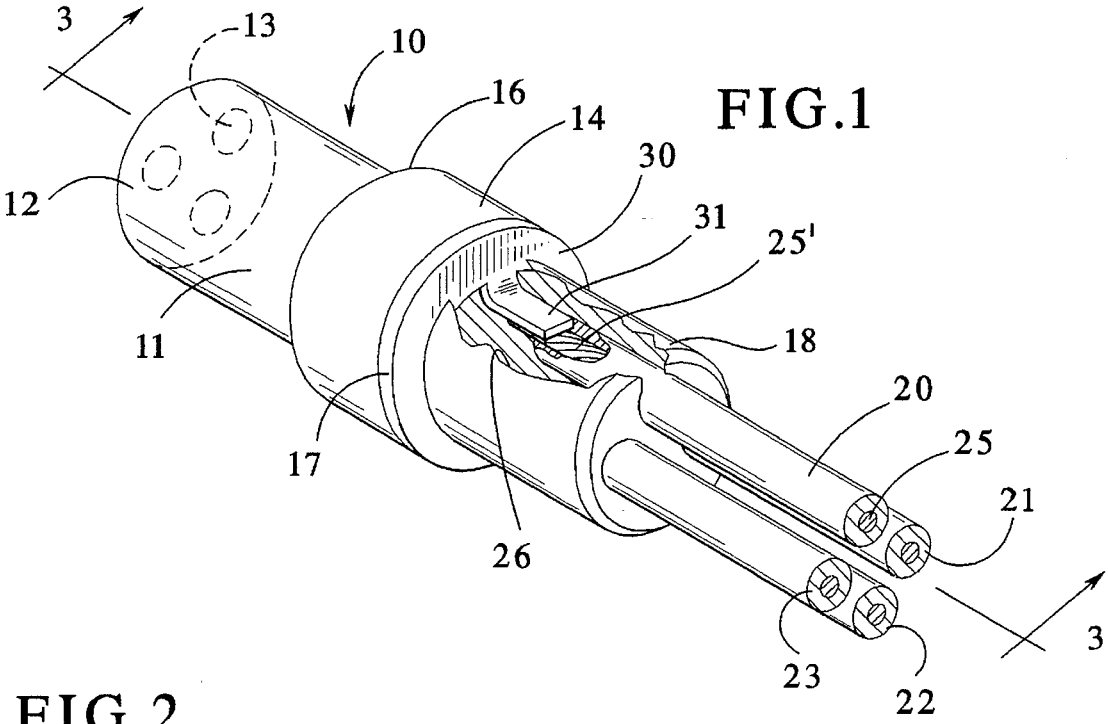
FIG.1
FIG.2
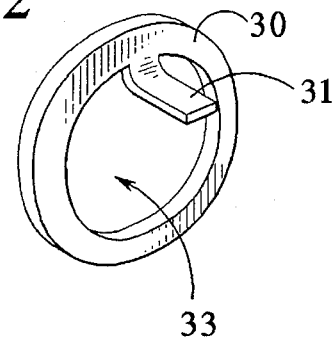
FIG.3
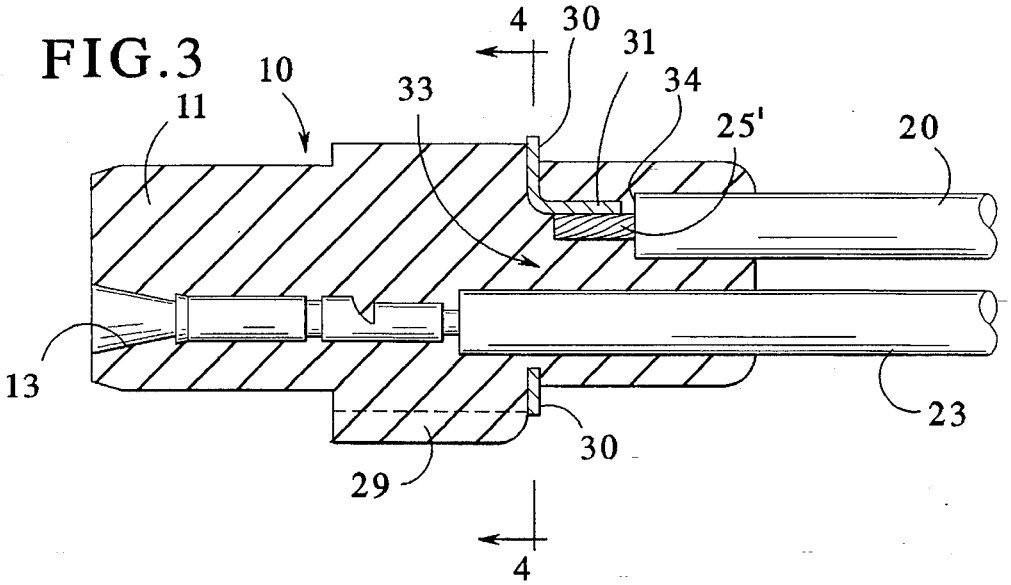

MOLDED CONNECTOR WITH INTERNAL GROUNDING

BACKGROUND OF THE INVENTION

This invention pertains to an electrical connector and in particular, a molded connector with an internal grounding and compression flange.

Electrical connectors used in applications requiting grounding are common. One way grounding has been accomplished is by having a ground wire welded to the surface of an electrically conductive connector shell which in turn is grounded by coming into contact with a grounded conductive, mechanical, bracket. Molded plastic or rubber connectors required a steel or stainless steel shell. It is also common for electrical connectors to be used in environments which require leak-proof connectors. Such connectors are used for pumps and must be submersible. In these applications, the outer metal shell of these connectors is also used as a point of compression to prevent leaking into the connector. These problems are overcome by the present invention by providing an internally grounded wire, connected to an exterior grounding washer which also functions as a compression flange. The present invention is easily and inexpensively manufactured.

It is an object of the present invention to provide a molded connector having an internal grounding wire termination.

It is another object of the present invention to provide an internal ground wire termination associated with an external grounding and compression flange.

It is a further object of the present invention to provide a molded connector without an outer metal housing.

SUMMARY OF THE INVENTION

A molded electrical connector is provided having a ground washer having an internal tab which may be welded to a ground wire. The plastic connector is injection molded around the wires, washer and contacts. The ground washer is interposed in the connector and upon mounting of the connector, compression of a bracket against the ground washer provides: compression against a center shoulder of the connector, a compressed mating of connectors creating a leakproof condition and the grounding of the connector.

The tab of the ground washer is located on the inside diameter of the ground washer. The tab of the ground washer is formed at a right angle to the ground washer and located inside of the connector. The tabs internal location protects and limits the exposure of, and breakage or damage to, the ground connection. The ground washer provides for grounding of the connector as well as a compression flange, eliminating the need for a costly separate stainless steel shell.

These and other features of the invention are set forth below in the following detailed description of the presently preferred embodiments.

BRIEF DESCRIPTION OF THE DRAWINGS

FIG. 1 is a perspective view of the electrical connector of the present invention showing a break-away view of the molded connector;

FIG. 2 is a perspective view of the ground washer of the present invention;

FIG. 3 is a side elevation cut-away view taken at line 3—3 of FIG. 1 of the present invention;

DETAILED DESCRIPTION OF THE PRESENTLY PREFERRED EMBODIMENTS

Figure 4:
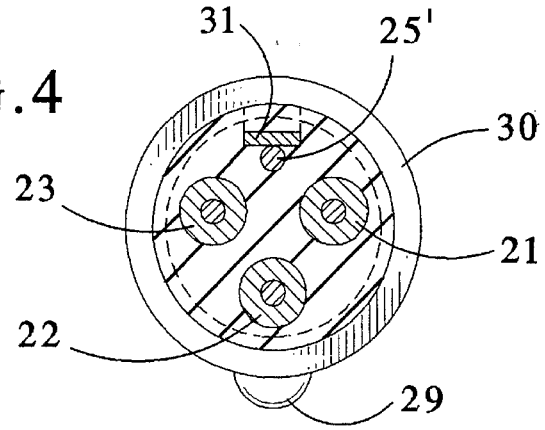
FIG. 4 is a side elevation cut-away view taken at line 4—4 of FIG. 3 of the present invention.

The present invention relates to an electrical connector as shown in FIGS. 1–5. Referring to FIG. 1, a perspective view of the electrical connector 10 is shown. The connector 10 consists of a plastic molded body 11. The body 11 includes female end 12, including female contacts 13 to receive male terminals. The connector body 11 includes a center section 14 having a front shoulder 16 and a rear shoulder 17. The connector body 11 has adjacent to the center section 14 a rear end 18. Received at rear end 18 are ground wire 20 and electrical wires 21,22,23. The wires include metal core 25.

Figure 5:
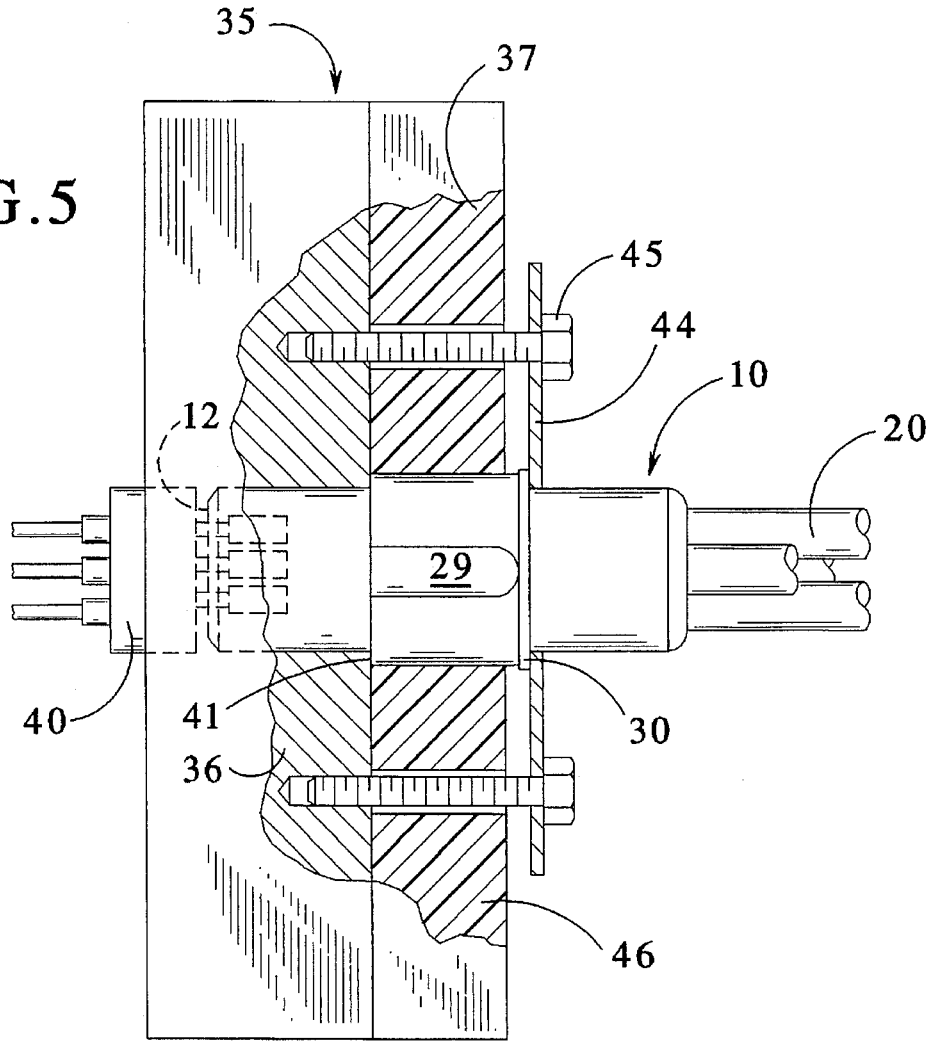
FIG. 5 is a side elevation of the present invention mounted to a substrate.

The rear body 18 is broken away at line 26. This break-away view shows the internal structure of the connector 10. Ground washer 30 abuts rear shoulder 17 of center portion 14 of the connector body 11. The ground washer includes tab 31 which is formed at a fight angle to the ground washer 30. Tab 31 is resistance welded to the core 25'of grounding wire 20. The molded body 11 is injection molded around the wires 20,21,22,23 the ground washer 30, the welded tab 31 and core 25'. This provides for a weld which is internal and not exposed to any external interferences. The connectors previously known in the art included a grounding wire welded to the surface of the separate conductive connector shell which was exposed to external forces which cause the weld to be easily disrupted removing the grounded connection. The present invention allows for the tab 31, welded to the ground wire 20, to be grounded to an external source through the exposed outer ground washer 30, as shown in FIG. 5.

FIG. 2 shows the ground washer 30 of the present invention having tab 31. The tab 31 is integral to the ground washer 30 and formed at a right-angle to the surface of the ground washer 30. In the preferred embodiment of this invention, the ground washer 30 is formed of stainless steel. It can be seen from this view that the forming of the tab 31 at a right-angle to the ground washer 30 provides for an enlarged center space 33 at the center of ground washer 30. After welding of the ground wire 20 to the tab 31, the other electrical wires 21,22,23 may be fed through the center space 33 of the ground washer 30.

FIG. 3 is a side elevation view taken at line 3—3 of FIG. 1 of the present invention. The molded body 11 is shown being molded around all of the components of the connector. Female contact 13 is shown connected to electrical wire 23. Ground wire 20 is shown having center core 25 prime protruding from the insulation 34 of the grounding wire 20. Grounding washer 30 includes integral tab 31 which is welded to the metal core 25'of the grounding wire 20. The other wires 21,22,23 are then inserted through center space 33 of the grounding washer 30 including female contacts 13. The body 11 is then injection molded around the electrical wires 20,21,22,23, contacts 13 and ground washer tab 31 forming body 11. Polarization rib 29 is shown at the outer surface of body 11.

FIG. 4 shows an elevation view taken at line 4—4 of FIG. 3. This cut-away view is taken at the rear shoulder 17 of the center portion 14 of the body 11. Ground washer 30 encircles the rear end 18 having three electrical wires 21,22,23 and metal core 25'of the ground wire 20 welded to tab 31. Polarization rib 29 provides for the proper mating orientation of the connector 10.

FIG. 5 shows the connector 10 of the present invention mounted to a substrate 35. The substrate is cut-away at line 37 so that the electrical connector 10 may be viewed more clearly. The electrical connector 10 is mated by inserting the female end 12 through a non conductive substrate 46 and conductive substrate 36 into a receptacle 40. The front shoulder 16 of the center portion 14 of the body 11 abuts a conductive substrate shoulder 4 1 upon complete insertion of the connector 10 into the receptacle 40. Following full insertion, conductive bracket 44 is placed around connector 10 and is tightened down to substrate 46 via fastening means 45 and comes into direct metal-to-metal contact with the ground washer 30 providing for grounding of the ground wire 20 to the conductive bracket 44 and to the conductive substrate 36. Simultaneously as connector 10 is tightened down to substrate 36 via fastening means 45, conductive bracket 44 presses against ground washer 30 compressing the connector 10, against the conductive substrate 36 shoulder 41 and the receptacle 40 to ensure a leak-proof mated condition of the connector 10. Polarizing rib 29 shown mated within the non conductive substrate 46 so that the wires are in proper orientation.

The description above has been offered for illustrative purposes only, and it is not intended to limit the scope of the invention of this application which is defined in the following claims.

What is claimed is:

1. An electrical connector having insulated electrical wire, electrical socket contacts, a molded body and an internal ground washer to function as a grounding surface and a compression flange to create a leakproof, grounded connection comprising:

a molded connector body;

a metal ground washer having an integral tab protruding toward the center of said ground washer;

a ground wire welded to said tab;

said welded portion of said ground wire surrounded by said molded connector body; and said ground washer interposed in said connector body and having an exposed outer surface for receiving a conductive fastener to be fastened thereon wherein upon securement of said conductive fastener, said connector is compressed into a mated condition and said ground wire is grounded to said conductive fastener.

2. The molded connector of claim 1 wherein said tab is formed at a right angle to the surface of said ground washer.

3. The molded connector of claim 1 wherein said connector includes four electrical wires.

4. The molded connector of claim 3 wherein said connector includes three female receptacle contacts.

5. A method of making a molded electrical connector having an internal ground washer having an exposed outer surface comprising the steps of:

welding a tab of a ground washer to a ground wire;

inserting electrical wires having contacts through the center of said ground washer; and injection molding a connector body around said tab and electrical wires.

6. The method of making an electrical connector of claim 5 wherein said tab is resistance welded to said ground wire.

* * * * *